United States Patent [19]

Fisher et al.

[11] 4,032,359

[45] June 28, 1977

[54] REMOVAL OF ALUMINIUM RICH COATINGS FROM HEAT RESISTING ALLOYS

[75] Inventors: Maurice Fisher; Michael Kruger; Terence Walter Maber, all of Bristol, England

[73] Assignee: Rolls-Royce (1971) Limited, Great Britain

[22] Filed: Aug. 4, 1975

[21] Appl. No.: 601,930

[30] Foreign Application Priority Data

Aug. 8, 1974 United Kingdom ..... 34760/74

[52] U.S. Cl. ..... 134/3; 156/664; 156/665; 252/79.2; 252/79.3

[51] Int. Cl.[2] ..... C23F 1/00; C23G 1/02

[58] Field of Search ..... 156/18, 22, 21, 23, 156/7; 252/79.2, 79.3; 427/226, 229, 154; 134/3, 28

[56] References Cited

UNITED STATES PATENTS

| | | | |
|---|---|---|---|
| 3,425,881 | 2/1969 | Cohn | 252/79.2 |
| 3,565,771 | 2/1971 | Gulla | 252/79.2 |
| 3,859,149 | 1/1975 | Kay | 252/79.2 |

*Primary Examiner*—Charles E. Van Horn
*Assistant Examiner*—Jerome W. Massie
*Attorney, Agent, or Firm*—Stevens, Davis, Miller & Mosher

[57] ABSTRACT

A solution for removing a diffused aluminium coating from a component made of nickel or cobalt base high temperature alloy, consisting of Nitric Acid 57%, Sulphuric Acid 29% and Water 14%. The solution removes all but traces of nickel or cobalt-rich aluminides and does not attack the substrate material. If said traces have to be removed also, there is used an etching solution consisting of Ferric Chloride Solution 85%, Sulphuric Acid 10% and Hydrofluoric Acid 5%.

5 Claims, No Drawings

REMOVAL OF ALUMINIUM RICH COATINGS FROM HEAT RESISTING ALLOYS

This invention relates to the removal of aluminium-rich coatings from heat-resisting alloys having a nickel or cobalt base.

It is known to provide components made of said alloys, e.g. tubine blades for gas turbine engines, with an aluminium-rich coating for the purpose of improving high temperature oxidation and sulphidation resistance of the alloy. When such components have been in use for some time there arises the need to remove the coating. For example, the coating may be damaged or partly eroded and has to be removed before a fresh coating can be applied. Also, it may be desirable to gain access to the substrate material for purposes of inspection, e.g. for the detection of surface cracking. The removal or "stripping" of the coating can be done by chemical dissolution.

The resistance to dissolution of aluminium of the coating is low compared with the substrate material and reagents are available which can readily remove a layer of pure aluminium from the surface of a nickel or cobalt base alloy without attack on the substrate. But in cases where the aluminium has been applied by a diffusion process there is a difficulty in removing the aluminium without attack on the substrate. The difficulty arises essentially from the intimate mutual penetration of the aluminium and the substrate material during diffusion. Also the aluminium and certain constituents of the substrate material form aluminides whose resistance to dissolution is relatively high. Especially, the concentration of aluminium in the aluminides diminishes towards the interior of the component and the resistance to dissolution correspondingly increases.

It is an object of this invention to provide a method of removing said coatings in which the above difficulties are reduced or overcome.

According to this invention the method of removing a diffused aluminium coating from a component made of nickel or cobalt base high-temperature alloy, comprises the step of immersing the component in a solution consisting essentially of, by volume:

| | |
|---|---|
| Nitric Acid | 50–70% |
| Sulphuric Acid | 25–50% |
| Water | Remainder (if any) |

The solution described is effective in removing aluminium at reasonable speeds and, for practical purposes, the action of the solution stops when the concentration of diffused aluminium has reached proportions which, for certain purposes, say the preparation of the component for re-aluminising, are insignificant.

Thus the solution has a reasonably rapid action and a sharp cut-off point. This is very desirable from the point of view of practical process control. If it should happen that the component is left in the solution for longer than is necessary, there is no attack on the substrate and no harm is done.

However, the small proportion of aluminide which can be left prevents access to the pure substrate material as may be required for metallurgical inspection. Where the latter operation is required the method according to this invention includes the further step of immersing the component in a solution consisting essentially of, by volume:

| | |
|---|---|
| Ferric Chloride Solution | 75–90% |
| Sulphuric Acid | 5–20% |
| Hydrofluoric Acid | 3–7% |

The solution used in the further step is capable of attacking the substrate but it need be used for only a brief period, say 2 to 15 minutes compared to one hour for the first step, and control is correspondingly easier.

An example of the method according to this invention will now be described. The component concerned is a turbine blade for a gas turbine engine and made of a base alloy essentially consisting of (by weight):

| | |
|---|---|
| Cobalt | 14.5 – 16% |
| Molybdenum | 2.7 – 3.5% |
| Aluminium | 5.0 – 5.9% |
| Titanium | 4.7 – 5.6% |
| Chromium | 9.5 – 10.5% |
| Nickel | Remainder |

The component has an aluminium-rich coating i.e. a coating having an aluminium content substantially higher than that of the base alloy. The coating is produced by a surface diffusion process comprising packing the component in a powder of alumina 85%, aluminium 14%, ammonium bromide 1%, and heating the pack to a temperature of 950°–100° C for a determined period to produce a coating containing up to 30% aluminium mainly in the form of a nickel aluminide; all as known from our United Kingdom Pat. No. 1,003,222. The depth of the coating increases with subsequent operational use of the component in the gas turbine engine at temperatures of 800°–900° C and is usually of the order of 0.001 to 0.0025 inch.

After a predetermined period of service, the substrate has to be removed, e.g. for the purpose of renewing a coating which has been wholly or partially eroded or for the purpose of inspecting the component for cracks at the surface of the substrate.

To remove the coating, the component is immersed in a solution consisting (by volume) of:

| | | |
|---|---|---|
| Nitric Acid | 57% | (Sp. Gr. 1.42) |
| Sulphuric Acid | 29% | (Sp. Gr. 1.84) |
| Water | 14% | |

The solution is maintained at a temperature of 85° ± 5° C.

The period of immersion necessary to remove a 0.0025 inch coating was 1 hour. Since the content of aluminium is highest near the surface of the coating and least at the interface with the substrate, the rate of dissolution declines as the coating is dissolved. When the substrate is reached the rate of dissolution becomes for practical purposes nil. Tests have shown that the rate at which the pure base alloy is dissolved by the exemplary solution is of the order of 2 microns per hour. Thus, no significant damage is done if the period of 1 hour is accidentally exceeded or if the solution contacts non-coated part of the component surface. However, the process is sensitive to temperature and above, say, 95° C there is marked attack on the substrate as well as decomposition of the acids.

The problem of avoiding chemical attack on the base metal applies also to any brazed joints which the component may have. In the present example, using the above stripping solution and immersion time and using a nickel-based brazing material for the brazed joints, no significant attack on the joint is observable by subsequent metallographic examination. The nickel-based brazing alloys may consist essentially of (by weight):

| | |
|---|---|
| Boron | 3.0% |
| Silicon | 4.5% |
| Carbon | 0.006% max. |
| Nickel | Remainder |

An alternative composition of braze material suitable for the present purpose consists essentially of (by weight):

| | |
|---|---|
| Boron | 2.5% |
| Silicon | 3.5% |
| Carbon | 0.006% |
| Chromium | 10% |
| Tungsten | 10% |
| Iron | 3.5% |
| Nickel | Remainder |

After said 1 hour period the component is rinsed, brushed with a soft brush and air-dried. Finally, the component may be etched if it is required to expose the grain structure of the substrate, e.g. for metallurgical inspection. The etching solution, which is capable of dissolving remnants of the coating i.e. nickel-rich alumnides, may comprise by volume:

| | | |
|---|---|---|
| Ferric Chloride solution | 85% | (Sp. Gr. 1.3) |
| Sulphuric Acid | 10% | (Sp. Gr. 1.84) |
| Hydrofluoric Acid | 5% | (60% W/W) |

The etching solution is at room temperature and immersion is for up to 15 minutes. Brazed joints are protected by masking.

The above example is equally applicable to a cobalt based alloy essentially consisting of (by weight):

| | |
|---|---|
| Carbon | 0.4 - 0.5% |
| Chromium | 20 - 25% |
| Nickel | 8 - 12% |
| Tungsten | 6 - 8% |
| Iron | 1 - 2% |
| Cobalt | Remainder |

What we claim is:

1. A method of removing an aluminide coating from a component made of a material based on an element selected from the group consisting of nickel and cobalt, comprising the step of immersing said component in a solution consisting essentially of, by volume:

| | |
|---|---|
| Nitric Acid | 50-70% (Sp. Gr. 1.42) |
| Sulfuric Acid | 25-50% (Sp. Gr. 1.84) |
| Water | Remainder (if any). |

2. A method of removing an alumnide coating from a component made of a material based on an element selected from the group consisting of nickel and cobalt, comprising the step of immersing said component in a solution consisting essentially of, by volume:

| | | |
|---|---|---|
| Nitric Acid | 50-70% | (Sp. Gr. 1.42) |
| Sulfuric Acid | 30-50% | (Sp. Gr. 1.84). |

3. A method of removing an aluminide coating from a component made of a material based on an element selected from the group consisting of nickel and cobalt, comprising the step of immersing said component in a solution consisting essentially of, by volume:

| | | |
|---|---|---|
| Nitric Acid | 50-70% | (Sp. Gr. 1.42) |
| Sulfuric Acid | 25-35% | (Sp. Gr. 1.84) |
| Water | Remainder (if any). | |

4. The method of claim 2 wherein said solution consists essentially of, by volume:

| | | |
|---|---|---|
| Nitric Acid | 50-60% | (Sp. Gr. 1.42) |
| Sulfuric Acid | 25-30% | (Sp. Gr. 1.84) |
| Water | Remainder (if any). | |

5. The method of claim 1 comprising the further step of removing said component from said solution after a predetermined time, and immersing said component in a further solution consisting essentially of, by volume:

| | |
|---|---|
| Ferric Chloride Solution | 75-90% (Sp. Gr. 1.3) |
| Sulfuric Acid | 5-20% (Sp. Gr. 1.84) |
| Hydrofluoric Acid | 3-7% (60% w/w). |

* * * * *